US007730836B2

(12) United States Patent
Schnell

(10) Patent No.: US 7,730,836 B2
(45) Date of Patent: Jun. 8, 2010

(54) METHOD OF ALIGNING A PRINTING PLATE AGAINST A STOP

(75) Inventor: Götz Schnell, Vimodrone (IT)

(73) Assignee: Heidelberger Druckmaschinen AG, Heidelberg (DE)

( * ) Notice: Subject to any disclaimer, the term of this patent is extended or adjusted under 35 U.S.C. 154(b) by 303 days.

(21) Appl. No.: 12/022,618

(22) Filed: Jan. 30, 2008

(65) Prior Publication Data

US 2008/0190312 A1 Aug. 14, 2008

(30) Foreign Application Priority Data

Feb. 9, 2007 (DE) ..... 10 2007 006 495

(51) Int. Cl.
*B41L 3/08* (2006.01)
*B41F 21/00* (2006.01)

(52) U.S. Cl. ..... 101/486; 101/415.1; 101/484; 101/DIG. 36

(58) Field of Classification Search ..... 101/378, 101/382.1, 383, 481, 484, 485, 486, DIG. 36; 33/614, 617, 618, 619, 621
See application file for complete search history.

(56) References Cited

U.S. PATENT DOCUMENTS 5,461,980 A * 10/1995 Maejima et al. ..... 101/415.1
6,481,349 B2 * 11/2002 Jehring et al. ..... 101/415.1
6,510,793 B1 * 1/2003 Kerr et al. ..... 101/382.1
6,845,713 B1 * 1/2005 Schumann et al. ..... 101/477

FOREIGN PATENT DOCUMENTS

DE 103 54 429 A1 7/2004
EP 1 052 095 A1 11/2000
JP 11262997 A * 9/1999

* cited by examiner

*Primary Examiner*—Ren Yan
(74) *Attorney, Agent, or Firm*—Laurence A. Greenberg; Werner H. Stemer; Ralph E. Locher

(57) ABSTRACT

A reliable method of aligning a printing plate against a stop includes moving the printing plate and the stop relative to each other, detecting temperature changes occurring at a temperature sensor connected to the stop, when the printing plate comes into contact with the stop, deriving signals indicating the position of the printing plate relative to the stop from the signals of the temperature sensor, and deriving a signal indicating the thermal conductivity between the printing plate and the stop from a speed of change of the temperature sensor signal. A signal indicating incorrect alignment of the printing plate against the stop is output if the thermal conductivity drops below a predetermined threshold.

6 Claims, 3 Drawing Sheets

FIG. 1
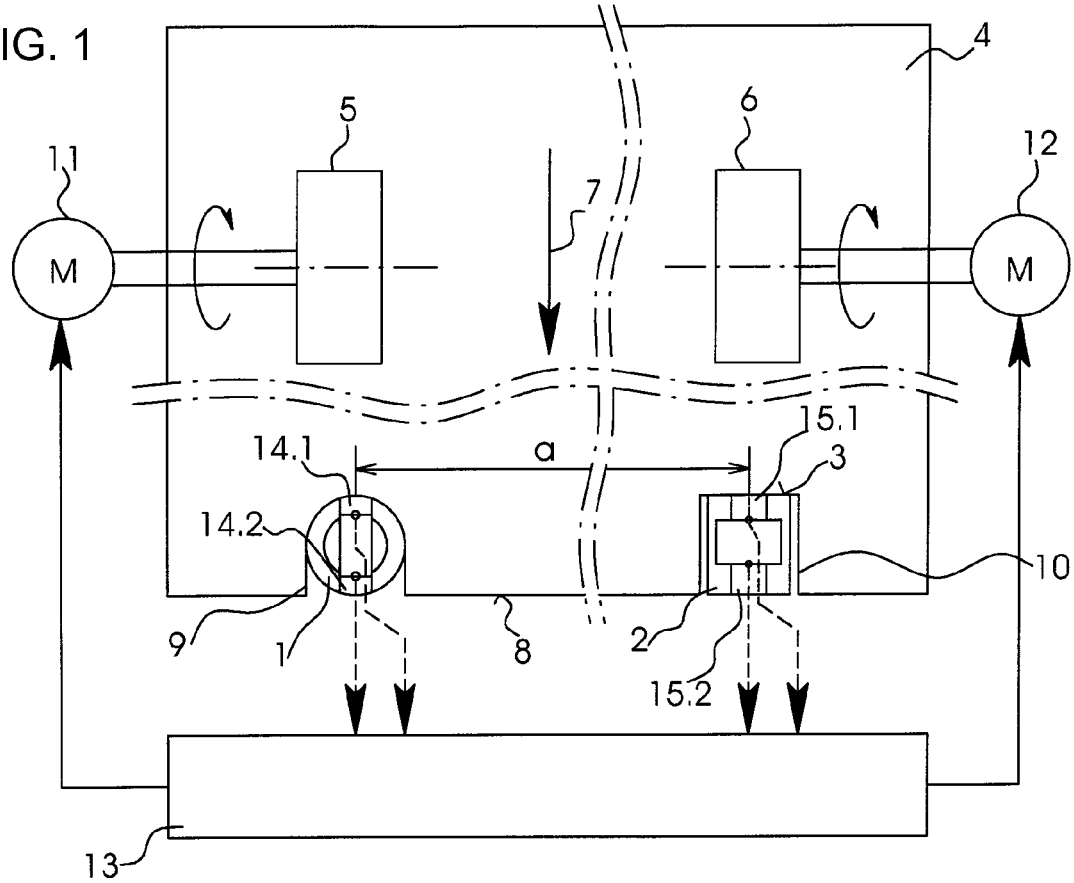
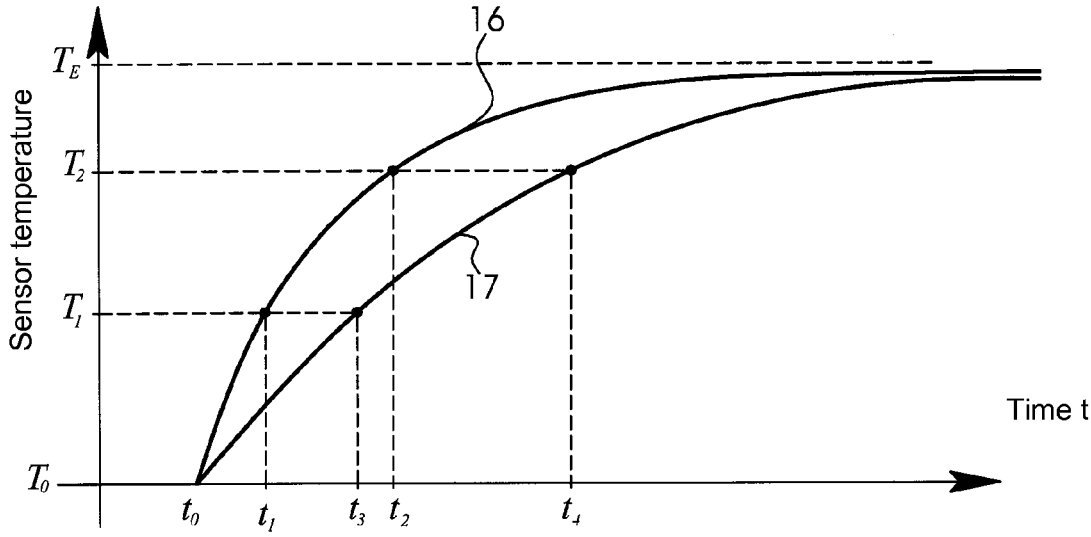
FIG. 2

FIG. 3
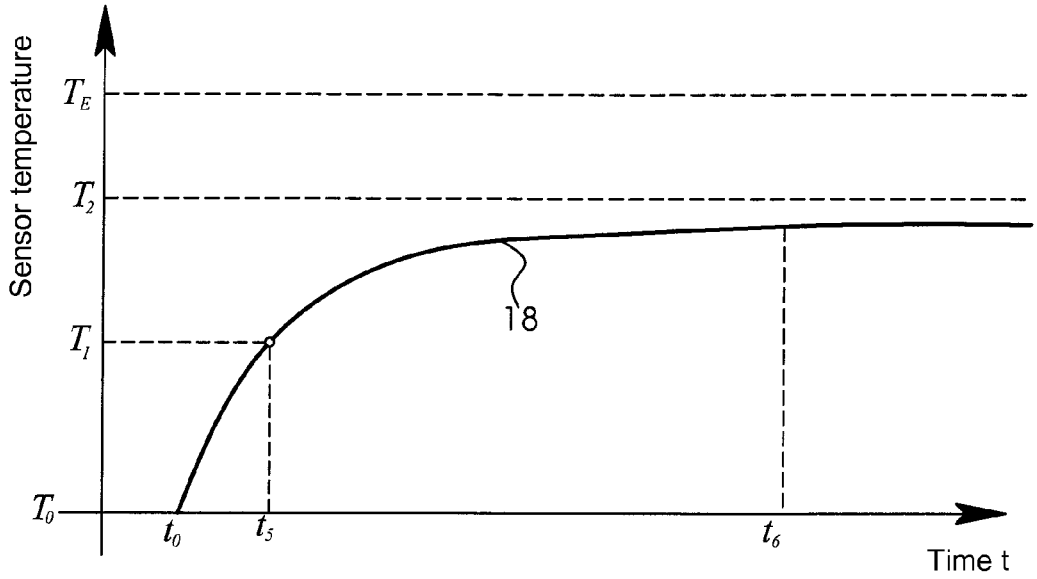
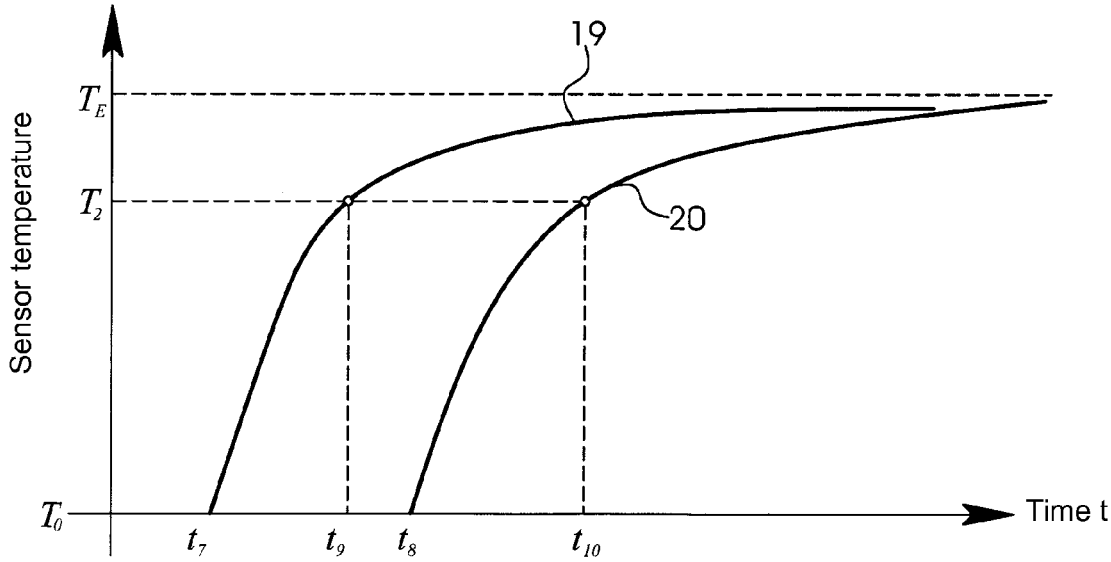
FIG. 4

METHOD OF ALIGNING A PRINTING PLATE AGAINST A STOP

CROSS-REFERENCE TO RELATED APPLICATION

This application claims the priority, under 35 U.S.C. §119, of German Patent Application DE 10 2007 006 495.2, filed Feb. 9, 2007; the prior application is herewith incorporated by reference in its entirety.

BACKGROUND OF THE INVENTION

Field of the Invention

The invention relates to a method of aligning a printing plate against a stop, which includes moving the printing plate and the stop relative to each other, detecting temperature changes occurring at a temperature sensor connected to the stop, when the printing plate contacts the stop, and deriving signals indicating a position of the printing plate relative to the stop from the signals of the temperature sensor.

German Published, Non-Prosecuted Patent Application DE 103 54 429 A1 discloses a device for detecting the position of a printing plate relative to a register pin. The device includes at least one detector responding to temperature changes. In one of the embodiments, calorimetric detectors are integrated into the register pins. As soon as the printing plate contacts the register pins, a heat exchange takes place between the printing plate and the detector. A signal that the printing plate has been aligned against the register pin can be generated by evaluation of a temperature change signal emitted by the detector.

The degree of accuracy in detecting the position of the printing plate against the register pins depends on the heat transfer resistance between the respective register pin and the printing plate. Contamination of the register punching of the printing plate and of the register pin can have a detrimental effect on the accuracy of the detecting device or may even cause a failure of the detecting device.

BRIEF SUMMARY OF THE INVENTION

It is accordingly an object of the invention to provide a method of aligning a printing plate against a stop, which overcomes the hereinafore-mentioned disadvantages of the heretofore-known methods of this general type and which provides increased reliability.

With the foregoing and other objects in view there is provided, in accordance with the invention, a method of aligning a printing plate against a stop. The method comprises moving the printing plate and the stop relative to each other, detecting temperature changes occurring at a temperature sensor connected to the stop, when the printing plate contacts the stop, deriving signals indicating a position of the printing plate relative to the stop from signals of the temperature sensor, deriving a signal indicating a temperature conductivity between the printing plate and the stop from a speed of change of the temperature sensor signal, and outputting a signal indicating incorrect alignment of the printing plate against the stop if the temperature conductivity falls below a predetermined threshold.

In accordance with the invention, a signal indicating a state of alignment of a printing plate against at least one stop is derived from the course over time, in particular the slope, of the signal of a calorimetric plate alignment detector. The signal indicating the alignment condition may contain information on a contamination of the stop or of the contacting zone between the printing plate and the stop. Moreover, the signal may contain information on the operating condition of a plate advancing device or on the correct lateral position of the plate. Based on the signal, a conclusion is drawn with respect to the conductivity between the printing plate and the stop. When the thermal conductivity drops below a predetermined threshold, a signal indicating incorrect alignment of the printing plate against the stop is output.

Other features which are considered as characteristic for the invention are set forth in the appended claims.

Although the invention is illustrated and described herein as embodied in a method of aligning a printing plate against a stop, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 is a schematic and block diagram of a device for aligning a printing plate against register pins;

FIG. 2 is a diagram for evaluating a contamination of a register pin;

FIG. 3 is a diagram for monitoring a plate advancing device;

FIG. 4 is a diagram for evaluating a skewed advancement of a printing plate.

DETAILED DESCRIPTION OF THE INVENTION

Figure 5:
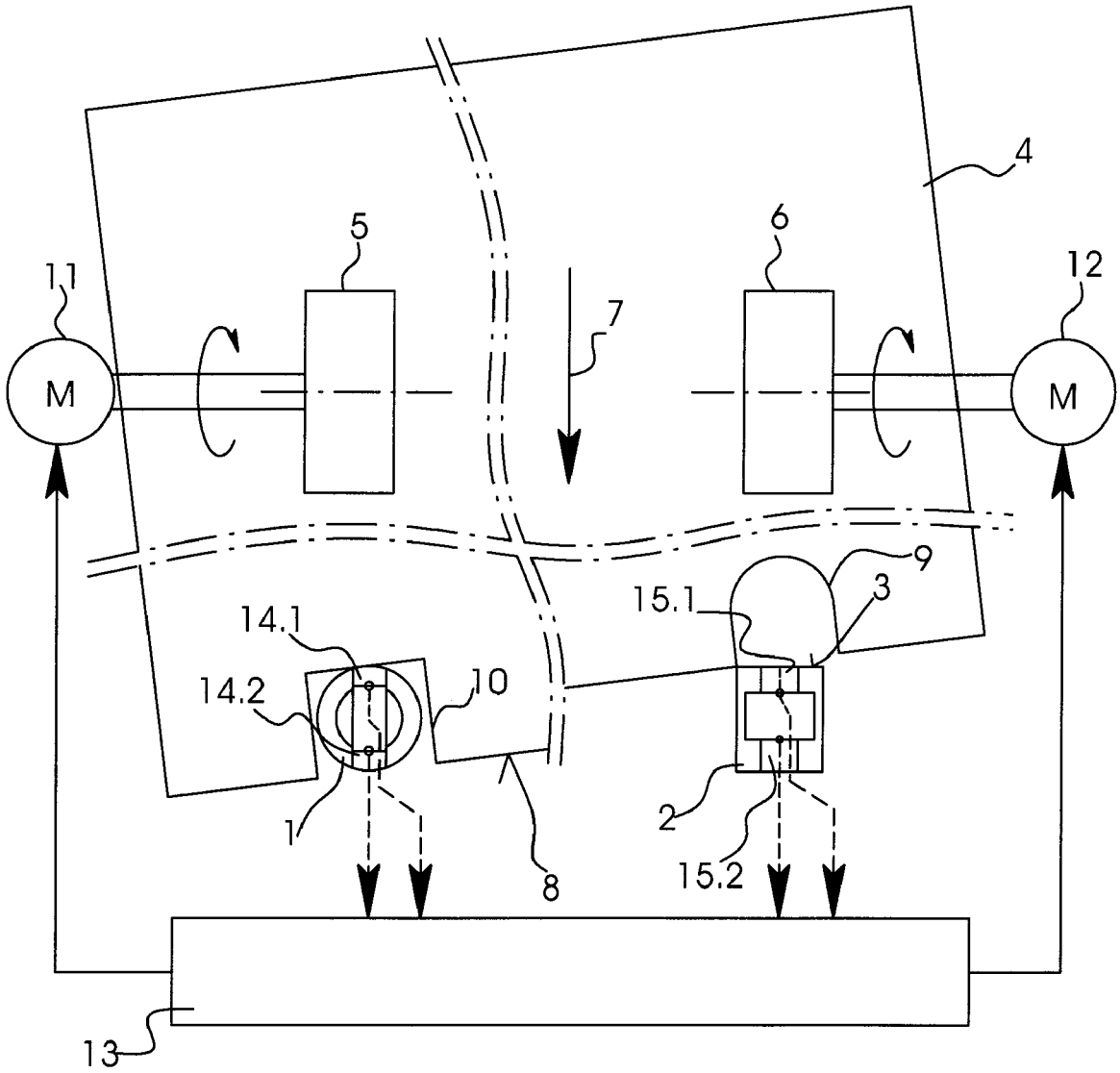
FIG. 5 is a schematic and block diagram of a printing plate that has been advanced with the wrong side up.

Referring now to the figures of the drawings in detail and first, particularly, to FIG. 1 thereof, there are seen register pins 1, 2 disposed on a plate cylinder along a straight line parallel to an axis of rotation of the plate cylinder. The register pin 1 has a circular cross-section. The register pin 2 has a rectangular cross-section with a contacting surface 3 that is parallel with the axis of rotation of the plate cylinder. In order to prepare a printing operation, a printing plate 4 is applied to the plate cylinder. The printing plate 4 is advanced in a direction 7 towards the register pins 1, 2 through the use of friction rollers 5, 6, with the register pins acting as stops. The printing plate 4 has a U-shaped recess 9 and a rectangular recess 10 at its front edge 8. A distance a between the recesses 9, 10 is the same as a distance between the register pins 1, 2. The friction rollers 5, 6 contact the surface of the printing plate 4 and are drivable by motors 11, 12. The motors 11, 12 are connected to a control unit 13.

The register pins 1, 2 are hollow. Inside each of the register pins 1, 2, there are two respective temperature sensors 14.1, 14.2 and 15.1, 15.2, which are disposed on a straight line that is parallel with the advancing direction 7 of the printing plate 4 and perpendicular to the axis of rotation of the plate cylinder. Lines connect the temperature sensors 14.1, 14.2, 15.1, 15.2 to the control unit 13. As soon as the printing plate 4 has been advanced by the friction rollers 5, 6 far enough for the recesses 9, 10 of the printing plate 4 to rest against the register pins 1, 2, heat exchanges take place in the respective contacting zones and cause temperature changes that can be sensed by the sensors 14.1, 14.2, 15.1, 15.2. If the printing plate 4 is in correct alignment with the register pins 1, 2, the sensors 14.1, 14.2, 15.1, 15.2 are at the center of the recesses 9, 10 as viewed in a direction perpendicular to the advancing direction 7.

A curve 16 shown in FIG. 2 represents an exemplary temperature development at the sensor 14.1 once the printing plate 4 has contacted the register pin 1 at a time $t_0$. Without contacting the recess 9, the sensor 14.1 has an initial temperature $T_0$. The signals of the sensors 14.1, 14.2, 15.1, 15.2 are evaluated in the control unit 13. The signals of the sensors 14.2, 15.2 are used to compensate for errors in the temperature measurements of the sensors 14.1, 15.1. After having been contacted by the recess 9, the temperature rises exponentially and reaches a first threshold $T_1$ at a time $t_1$. Subsequently, the temperature exceeds a second threshold $T_2$ at a time $t_2$. After a finite amount of time, the temperature at the sensor 14.1 is at a self-regulation level $T_E$. The threshold $T_1$ is approximately half way to the threshold $T_2$. The threshold $T_2$ is at ¾ of threshold $T_E$. When the temperature of the sensor 14.1 exceeds the threshold $T_1$, a timer is started in the control unit 13. The timer is stopped when the temperature exceeds the threshold $T_2$. Then the amount of time $(t_2-t_1)$ is compared to a predetermined period of time $D_1$. If $(t_2-t_1)<D_1$, a signal is generated to indicate that the recess 9 of the printing plate 4 correctly rests against the register pin 1. The signal can be used to actuate a plate locking device on the plate cylinder. The signal of the sensor 15.1 is evaluated in an identical, yet independent process.

If the recess 9 or the register pin 1 is contaminated by a rubber coating or printing ink, for example, or if there is an undesired oxide layer on the recess 9 or on the register pin 1, or if the contacting surface of the recess 9 is deformed in an unacceptable way, a signal output upon contact with the printing plate 4 corresponds to a signal represented by a curve 17. The temperature exchange between the register pin 1 and the printing plate 4 takes place more slowly. The thresholds $T_1$, $T_2$ are reached at times $t_3$, $t_4$, with $t_3$ being greater than $t_1$ and $t_4$ being greater than $t_2$. The timer determines the time $(t_4-t_3)$. If $(t_4-t_3)\geqq D_1$, a signal is generated to indicate that the signal of the sensor 14.1 cannot be used or that the printing plate 4 is incorrectly aligned with the register pin 1.

If an error occurred during advancement of the printing plate against the register pins 1, 2, the resultant temperature curve at the sensor 14.1 may correspond to a curve 18 in FIG. 3. The threshold $T_1$ is reached at a time $t_5$ and the threshold $T_2$ is not reached after a delay $(t_6-t_5)$. If the threshold $T_1$ has not been reached at a time $t_6$, a signal is output to indicate an error in the advancing device. The error may be that one of the friction rollers 5, 6 is dirty so that the rollers do not provide the required advancing forces.

FIG. 4 illustrates two curves 19, 20 indicating the temperature development at the sensors 14.1, 15.1. The temperature changes start at different times $t_7$, $t_8$. At a time $t_9$, the temperature at the sensor 14.1 reaches the threshold $T_2$. At the sensor 15.1, the threshold $T_2$ is reached after a certain delay at a time $t_{10}$. The control unit 13 determines the time $(t_{10}-t_9)$ and compares it to a predetermined period of time $t_2$. If $(t_{10}-t_9)>t_2$, a signal is generated to indicate that the printing plate has been advanced at an unacceptable angle. Such a skewed advancement of the printing plate may result from soiling of only one of the friction rollers 5, 6 or from maladjustment of guide elements for the printing plate 4.

The situation illustrated in FIG. 5 is the result of an advancement of the printing plate 4 with the wrong side facing up. When the recess 10 comes into contact with the register pin 1, the result is a signal change corresponding to the curve 16 in FIG. 2. The bottom of the recess 9 does not reach the contacting surface 3 on the register pin 2. As a result, no signal change occurs at the sensor 15.1. In this case, the control device 13 generates a signal to indicate that the printing plate 4 has been advanced with the wrong side facing up, i.e. that the printing plate would be mounted with the side of the plate carrying the image to be printed, facing the jacket surface of the plate cylinder.

The invention claimed is:

1. A method of aligning a printing plate against a stop, the method comprising the following steps:

moving the printing plate and the stop relative to each other;

detecting temperature changes occurring at a temperature sensor connected to the stop, when the printing plate contacts the stop;

deriving signals indicating a position of the printing plate relative to the stop from signals of the temperature sensor;

deriving a signal indicating a temperature conductivity between the printing plate and the stop from a speed of change of the temperature sensor signal; and outputting a signal indicating incorrect alignment of the printing plate against the stop if the temperature conductivity falls below a predetermined threshold.

2. The method according to claim 1, which further comprises predetermining a lower and an upper threshold for the signal of the temperature sensor.

3. The method according to claim 2, which further comprises:

determining a time period in which the signal is between the lower and upper thresholds; and outputting the signal indicating incorrect alignment if the time period exceeds a predetermined threshold.

4. The method according to claim 2, which further comprises outputting the signal indicating incorrect alignment if the signal exceeds the lower threshold and does not reach the upper threshold after a predetermined period of time.

5. The method according to claim 1, which further comprises:

providing another stop and another temperature sensor associated with the other stop;

providing two recesses in an edge of the printing plate, the recesses being at a distance from each other and having a shape matching a contacting shape of the two stops provided at the same distance from each other;

advancing the edge against the stops, and during the advancement of the edge checking if signals of the temperature sensors associated with the stops reach a threshold within a predetermined period of time; and outputting the signal indicating incorrect alignment if the signal of a sensor does not reach the threshold.

6. The method according to claim 1, which further comprises:

providing another stop and another temperature sensor associated with the other stop;

providing two recesses in an edge of the printing plate, the recesses being at a distance from each other and having a shape matching a contacting shape of the two stops provided at the same distance from each other;

advancing the edge against the stops, and during the advancement of the edge detecting a time when signals of the temperature sensors associated with the stops reach a threshold; and outputting the signal indicating incorrect alignment if a period of time between points in time when the threshold is reached at the two temperature sensors exceeds a predetermined period of time.

* * * * *